US008025111B2

(12) United States Patent
Hopf

(10) Patent No.: US 8,025,111 B2
(45) Date of Patent: Sep. 27, 2011

(54) AGITATOR FOR A DRILL AND RELATED METHODS

(75) Inventor: Kerry Hopf, Otwell, IN (US)

(73) Assignee: J.H. Fletcher & Co., Huntington, WV (US)

( * ) Notice: Subject to any disclaimer, the term of this patent is extended or adjusted under 35 U.S.C. 154(b) by 41 days.

(21) Appl. No.: 12/503,205

(22) Filed: Jul. 15, 2009

(65) Prior Publication Data

US 2010/0139986 A1 Jun. 10, 2010

Related U.S. Application Data

(63) Continuation of application No. PCT/US2009/050521, filed on Jul. 14, 2009.

(60) Provisional application No. 61/121,239, filed on Dec. 10, 2008.

(51) Int. Cl.
*E21B 21/16* (2006.01)
*E21B 7/00* (2006.01)

(52) U.S. Cl. ..... 175/213; 175/209; 175/212

(58) Field of Classification Search ..... 175/207, 175/209, 212, 213
See application file for complete search history.

(56) References Cited

U.S. PATENT DOCUMENTS

| | | | | |
|---|---|---|---|---|
| 2,279,186 | A | 4/1942 | Terry et al. | |
| 2,590,958 | A | 4/1952 | Goodrich | |
| 3,032,129 | A | 5/1962 | Fletcher et al | |
| 3,800,890 | A | 4/1974 | Gyongyosi et al. | |
| 3,946,818 | A | 3/1976 | Ek | |
| 4,081,041 | A | 3/1978 | Perri et al. | |
| 4,100,982 | A | 7/1978 | Wilkinson et al. | |
| 4,298,073 | A | 11/1981 | Yates | |
| 4,434,861 | A | 3/1984 | Howeth | |
| 5,320,188 | A | 6/1994 | England | |
| 5,651,420 | A | 7/1997 | Tibbitts et al | |
| 5,901,797 | A | 5/1999 | Hansen et al | |
| 7,510,356 | B2 * | 3/2009 | Colon | 408/1 R |

* cited by examiner

*Primary Examiner* — Giovanna Wright
(74) *Attorney, Agent, or Firm* — King & Schickli, PLLC

(57) ABSTRACT

An apparatus assists in preventing the accumulation of debris in a flow path during the formation of a borehole. In one embodiment, the apparatus comprises a drill head including a drive shaft for driving a drilling element to form the borehole. Preferably, the drilling element includes a passage forming a flow path for debris from the borehole. A carrier positioned adjacent the flow path is connected to at least one agitator connected to the carrier for agitating debris in the flow path. A related method pertains to manufacturing a drill head including an agitator.

24 Claims, 1 Drawing Sheet

AGITATOR FOR A DRILL AND RELATED METHODS

This application is a continuation of PCT patent application Ser. No. PCT/US09/50521 Jul. 14, 2009 which claims the benefit of U.S. Provisional Patent Application Ser. No. 61/121,239 filed Dec. 10, 2008, the disclosure of which is incorporated herein by reference.

TECHNICAL FIELD

The present invention relates to the earth drilling or roof bolting arts and, more particularly, to apparatus and methods for assisting in preventing the accumulation of debris in a flow path associated with a drilling unit.

BACKGROUND OF THE INVENTION

Most earth drilling systems employ some form of rotary or percussion powered drills. Typically, a drilling machine, such as for forming a hole for an explosive charge, or for anchoring a roof bolt, includes a drill socket for receiving a stem with a drill bit on the distal down hole section thereof. The stem/bit on a rotary drill machine is rotated by a shaft, sometimes called a spinner, mounted on a drill head to form the drill hole. The rotary driving motion of the spinner is usually hydraulically or pneumatically driven.

To increase the efficiency of drilling, cuttings and dust are often collected and removed from adjacent the drill bit. The removal of the cuttings and dust from adjacent the drill bit reduces airborne contamination, provides clean cutting edges at the bottom of the hole, and allows the most efficient contact with the rock, or other strata. Typically, a pneumatic or hydraulic cuttings/dust collection/suppression and removal system is employed. In one example, pressurized air, or a suitable hydraulic fluid such as water, or an air/water mixture, is forced into the borehole to bail or pick up the cuttings and dust for disposal. In one particular embodiment, this goal is achieved by applying a vacuum on a center passage of the drill steel to draw bailing fluid into the borehole around the periphery of the drill steel, whereupon the cuttings and the dust particles are entrained and removed through the center passage. In either system, this withdrawn debris is initially pneumatically or hydraulically conveyed away from the drill hole. A typical drilling arrangement and cuttings/dust collecting system is shown in the prior art; Howeth, U.S. Pat. No. 4,434,861, and Wilson, U.S. Pat. Nos. 6,637,522 and 6,216,800, the disclosures of which are incorporated herein by reference.

When using air, the cuttings and dust are then filtered out at a remote location and disposed of. In systems where water is used, either exclusively or in a mixture with other fluids, an option is to simply allow the dust to be suppressed and then deposited outside the drill hole.

Regardless of which system is employed, debris may accumulate in the center passage and areas surrounding the center passage, during the removal of the cuttings and dust. The debris tends to form a cake-like substance, especially when it is wet and especially when the flow path is not completely linear. This accumulation of debris inhibits flow and prevents the effective conveyance of the cuttings and dust away from the borehole. When this occurs, the drill bit becomes isolated from the distal cutting face of the hole by the debris, and effective drilling cannot continue. In addition, the cuttings and dust begin to create airborne contamination. Thus, drilling is often interrupted to remove the debris, resulting in drilling delays, inefficiencies, and expenses.

Accordingly, a need is identified for a manner in which to assist in preventing the accumulation of debris in a flow path during a drilling operation, such as when forming a borehole in a face of a mine passage in association with a roof bolting operation.

SUMMARY OF THE INVENTION

One aspect of this disclosure relates to an apparatus for assisting in preventing the accumulation of debris in a flow path during the formation of a borehole in a face of a mine passage using a drill bit. The apparatus comprises a drill head including a housing at least partially defining the flow path and further including a drive shaft for driving the drill bit to form the borehole. The apparatus further comprises at least one agitator positioned in the housing for agitating debris in the flow path.

Preferably, the at least one agitator extends transverse to a flow direction of a portion of the flow path associated with the drive shaft. However, the at least one agitator should be positioned so as not to obstruct the flow of dust and debris along the path. The at least one agitator may comprise an elongated rod or blade and, most preferably, comprises two agitators, which alone or together may be supported by a carrier connected to the drive shaft.

Another aspect is a drilling or bolting unit for use with a drilling element for forming a borehole in a face of a mine passage. The drilling unit comprises a drill head having a rotatable drive shaft for driving the drill bit to form the borehole. A carrier connected to the drive shaft connects to at least one agitator for agitating debris in the flow path.

The carrier may further include an opening forming a portion of the flow path, in which case the at least one agitator does not extend across the opening. The unit may further include a dust chamber within the housing. with the at least one agitator projecting into the dust chamber.

A further aspect of the disclosure is an apparatus for assisting in preventing the accumulation of debris in a flow path during the formation of a borehole in a face of a mine passage. The apparatus comprises a drill head including a drive shaft for driving the drill bit to form the borehole. The drill bit includes a passage forming a flow path for debris from the borehole. At least one agitator is associated with the drive shaft for agitating debris in the flow path.

Preferably, the drive shaft comprises a rotatable drive shaft including a passage in fluid communication with the passage of the drill bit. The apparatus may further include a carrier connected to the drive shaft for carrying the at least one agitator. The carrier in turn includes an opening in fluid communication with the passage of the drive shaft. Preferably, the agitator is mounted for movement with the drive shaft and, most preferably, comprises a pair of agitators.

Yet a further aspect of the invention is a method of manufacturing a drill head for assisting in preventing the accumulation of debris in a flow path during the formation of a borehole in a face of a mine passage using a drill bit actuated by a drive shaft. The method comprises connecting at least one agitator to the drive shaft for agitating debris in the flow path.

DETAILED DESCRIPTION OF THE DRAWINGS

Figure 1:
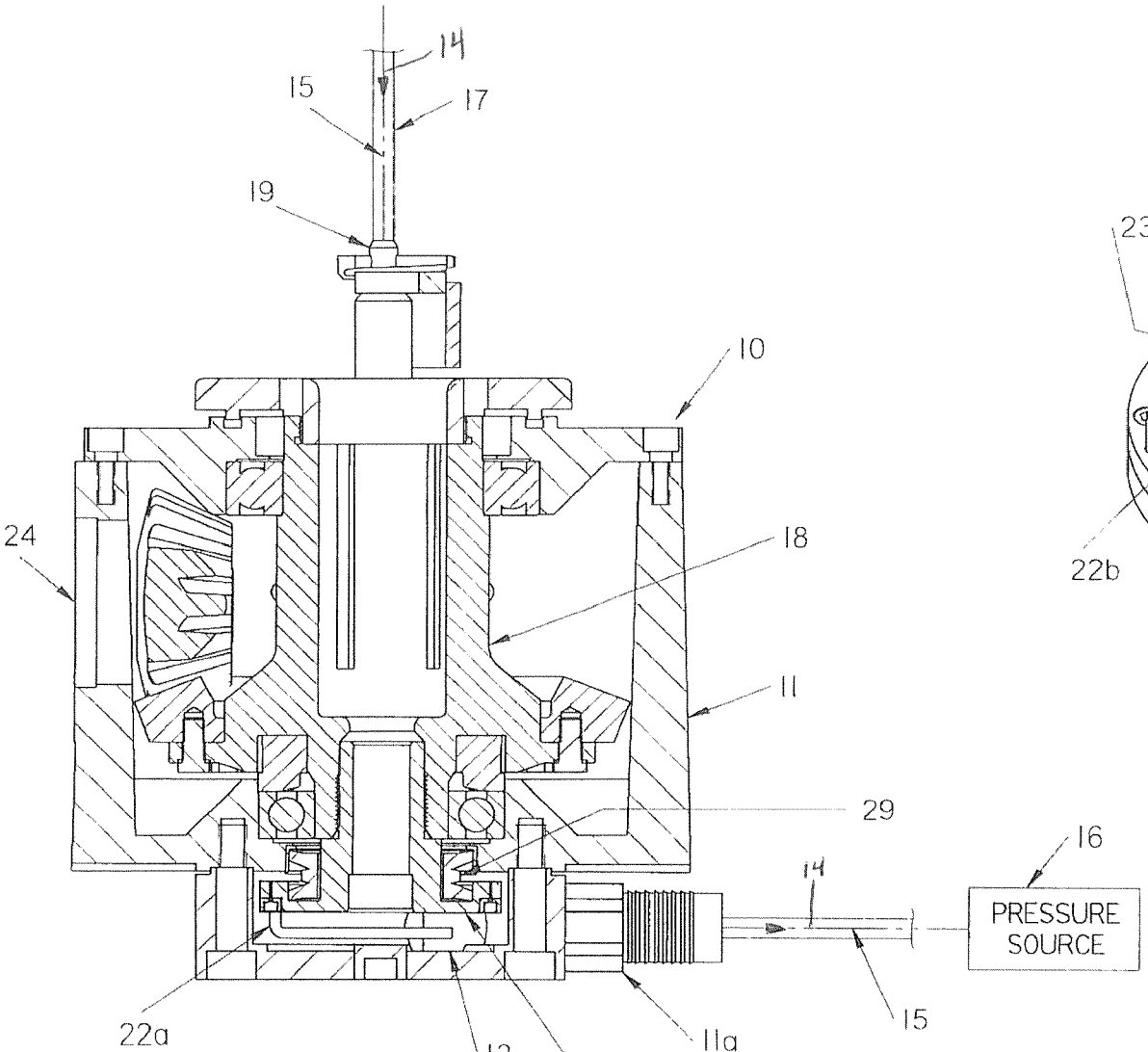
FIG. 1 is a cross-sectional view of a drill head incorporating the dust shredder described herein.

Reference is now made to FIG. 1, which is a cross-sectional view illustrating one embodiment of a drilling unit 10 with an apparatus 20 for assisting in preventing the accumulation of debris in a flow path 15 associated with the drilling unit. The drilling unit 10 may be used, for example, to form a borehole in a mine roof having rock strata forming the ceiling of the mine, and then to serve as a bolting unit to install a mechanical anchor, such as a roof bolt, in the borehole thus formed. However, this is merely one environment in which the drilling unit 10 of the present invention can be utilized. In addition to drilling in overhead strata, the drilling unit 10 of the present invention could be used in a side wall or in the floor of any earth strata, and for other purposes, including placement of explosive charges and the like.

As illustrated in FIG. 1, the drilling unit 10 includes a housing 11, which in turn includes a portion of the flow path 15 for delivering the debris, dust, and cuttings away for collection or disposal. The drilling unit 10 also includes a drive shaft 18, which is preferably mounted for rotation within the housing 11 by suitable bearings. A power source (not shown), such as a hydraulic motor, for rotating this drive shaft 18 relative to the housing 11, may be received at an input location 24 on the housing 11. Suitable gearing may be provided for this purpose.

To form the borehole, a drilling element 17, such as a drill steel including a "bit" may be received at the distal, down hole point of a socket 19 associated with the drive shaft 18. This socket 19 via the passage through the drill steel thus forms the inlet to the flow path 15 in the housing 11 for receiving the debris generated during drilling in this most preferred embodiment. In addition, the flow path 15 may be connected via an outlet 11*a* in the housing 11 to a pressure source 16, such as a vacuum. As should be appreciated, this will create a flow through the flow path 15 for receiving and then delivering the debris generated during the advance of the drill bit to form the borehole to a downstream location for collection and eventual disposal.

In accordance with one aspect of the disclosure, an apparatus 20 for assisting in preventing the accumulation of debris in the flow path 15 is provided. In the preferred and illustrated embodiment, this apparatus includes a carrier and at least one agitator 22*a* connected thereto. The carrier may take the form of any device capable of carrying the agitator 22*a*, such as a rotating mechanical face seal carrier 21, preferably positioned adjacent to the outlet 11*a* of the housing 11. The agitator 22*a* may take the form of any device capable of agitating debris but most preferably comprises an elongated blade or elongated rod (and, most preferably, comprises an L-shaped structure).

The carrier 21 may be connected to the rotatable shaft 18 used to induce rotation in the bit as the result of the power input. In the preferred embodiment, the mounting of the carrier 21 is such that it at least partially occupies an adjacent dust chamber 13, through which debris flows in moving along the flow path 15 and may accumulate in the course of the drilling operation. Preferably, the agitator 22*a* is arranged relative to the carrier 21 to project into the dust chamber 13 in a direction transverse to the direction of the flow 14 in the flow path 15. Also, the carrier 21 may be associated with a mechanical face seal 29 on the drilling unit 10, which is used to forestall dust and the like from infiltrating the bearings and gears associated therewith.

Figure 2:
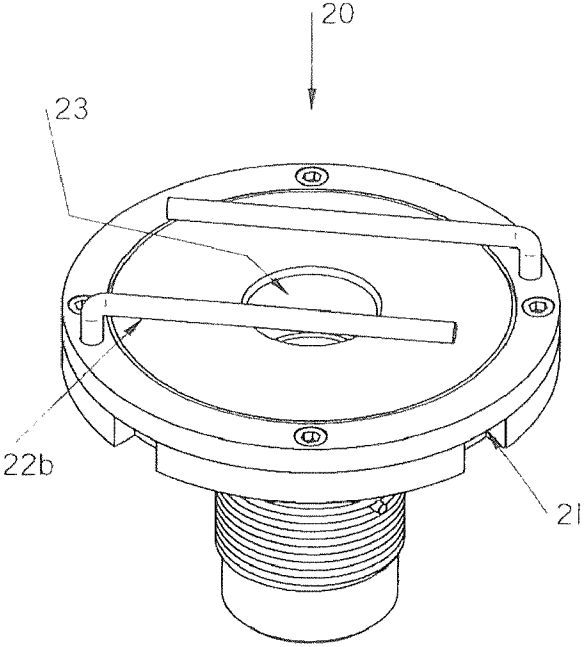
FIG. 2 is a perspective view of a rotary seal carrier including a pair of agitators for use in connection with a drill head for agitating dust and debris in the flow path.

A more detailed perspective view illustrating one embodiment of the apparatus 20, for assisting in preventing the accumulation of debris in the flow path, is shown in FIG. 2. As shown, a second agitator 22*b* may also be connected to the carrier 21, but this duality is considered optional. Based on its positioning in the preferred embodiment, the carrier 21 necessarily includes an opening 23, which thus forms a portion of the flow path in the housing 11 of the drilling unit 10 (and, more specifically, an outlet for allowing the dust and debris to enter the chamber 13). As is perhaps best understood with reference to FIG. 2, the spaced, generally parallel agitators 22*a*, 22*b* shown are fixedly mounted so as to not extend across the opening 23 of the carrier 21 or into the flow path 15, and thus do not obstruct the flow. However, the agitators 22*a*, 22*b* do extend into and move within a gap or space defined between the adjacent end of the opening 23 in the carrier 21 and the adjacent end of the opening 11*a* in the housing 11.

Returning to FIG. 1, the drilling unit 10 may be used with the drill bit to form the borehole in the following manner. A motive device (not shown) drives the housing 11 toward and away from a corresponding face of the mine passage to be drilled. In addition, the power source at the input location 24 on the housing 11 rotates the shaft 18 relative to the housing 11, which provides the rotation to cause the drill bit to cut the rock or other material forming the face of the mine passage being worked.

Of course, the formation of the borehole creates dust, cuttings, and other debris. Thus, the pressure source 16 creates the flow through the flow path 15 to bail or pick up the cuttings, dust, and other debris for disposal and to convey the debris away from the borehole. As the debris is conveyed through the flow path 15 and away from the borehole, the carrier 21, which is directly coupled to the shaft 18 in the preferred embodiment, moves relative to the housing 11 in a simultaneous fashion. Consequently, the agitators 22*a*, 22*b* (shown in FIG. 2) move about the axis of movement of the shaft 18 within the gap and thereby agitate or "shred" the debris and help to prevent caking and other forms of undesirable accumulation. "Agitate" as used herein refers to the disruption of the fluid carrying the dust and debris, as distinguished from the action of the fluid in conveying the dust and debris along the flow path.

Specifically, the agitators 22*a*, 22*b* extend transverse to the direction of the flow 14 in the flow path 15 and project into the dust chamber 13, defined by the carrier 21. During actuation of the drive shaft 18 to which the carrier 21 is bodily connected, the agitators 22*a*, 22*b* thus move at a correspondingly high rate of speed about the axis of rotation (or along it in the case of a non-rotational movement). In any case, this movement serves to create a shredding or swirling action in order to disrupt and agitate any debris in the dust chamber 13 (and, more specifically, in the gap between the outlet end of the opening 23 and the inlet end of the opening 11*a*). At the same time, the agitators 22*a*, 22*b* do not extend across the opening of the carrier 21 or into the flow path 15 (including the adjacent outlet 11*a* of the housing 11), In this manner, the agitators 22*a*, 22*b* do not serve as obstacles to obstruct the flow in a manner that would promote the accumulation of debris in the flow path 15. Indeed, the relatively slender, elongated nature of the agitators 22*a*, 22*b* in the preferred embodiment means that they occupy a minimal amount of space in the dust chamber 13 to avoid collecting dust or debris, but this of course does not detract from the ability to prevent accumulation in the desired manner given their positioning and relatively rapid movement.

Summarizing, the apparatus of the present invention assists in preventing the accumulation of debris in the flow path 15. Because debris does not accumulate and form a cake-like substance in the flow path 15, it remains clear and unclogged.

Thus, the flow may continue through the flow path 15 during drilling, and debris may be effectively conveyed away from the borehole. Further, airborne contamination created by debris from drilling is further reduced, and the drill bit may make efficient contact with the clean cutting edges of the distal cutting face of the borehole during drilling. Accordingly, drilling may continue without interruptions to remove accumulated debris from the drilling unit 10, increasing drilling efficiency and decreasing drilling delays and expenses.

The foregoing descriptions of various embodiments of the invention are provided for purposes of illustration, and are not intended to be exhaustive or limiting. Modifications or variations are also possible in light of the above teachings. For instance, one or more of the agitators 22*a*, 22*b* could be used to manufacture a drill head or retrofit an existing drill head, such as by operatively connecting with the drive shaft. Although the outlet 11 a is shown as being positioned along one lateral side of the housing 11, such that an elbow or bend in the flow path results, the flow path 15 could be linear as well. The embodiments described above were chosen to provide the best application to thereby enable one of ordinary skill in the art to utilize the disclosed inventions in various embodiments with various modifications as are suited to the particular use contemplated. All such modifications and variations are within the scope of the invention.

The invention claimed is:

1. An apparatus for assisting in preventing the accumulation of debris in a flow path during the formation of a borehole in a face of a mine passage using a drilling element, comprising:

a drill head including a housing at least partially defining the flow path, said housing including a rotatable drive shaft for driving the drilling element to form the borehole, said drive shaft having an internal passage forming part of the flow path; and at least one agitator positioned in the housing for agitating debris in the flow path.

2. The apparatus of claim 1, wherein the at least one agitator extends transverse to a flow direction of an upstream portion of the flow path.

3. The apparatus of claim 1, wherein the at least one agitator does not obstruct an opening of the drive shaft forming a portion of the flow path.

4. The apparatus of claim 1, wherein the at least one agitator comprises an elongated rod.

5. The apparatus of claim 1, wherein the at least one agitator comprises two agitators.

6. The apparatus of claim 1, further including a pressure source for inducing a flow of air along the flow path.

7. The apparatus of claim 1, wherein the drive shaft is rotatably mounted at least partially within the housing.

8. The apparatus of claim 1, further including a carrier connected to the drive shaft, said carrier supporting the at least one agitator.

9. A drilling or bolting unit for use with a drilling element for forming a borehole in a face of a mine passage, comprising:

a drill head including a housing having a rotatable drive shaft for driving the drilling element to form the borehole, said drive shaft at least partially defining a flow path for debris;

a carrier connected to the drive shaft; and at least one agitator connected to the carrier, the at least one agitator for agitating debris in the flow path;

wherein the at least one agitator does not obstruct an opening of the drive shaft forming a portion of the flow path.

10. The drilling unit of claim 9, wherein the at least one agitator is aligned with a flow direction of the flow path downstream of the carrier.

11. The drilling unit of claim 10, further including an opening in the carrier forming a portion of the flow path.

12. The drilling unit of claim 11, wherein the at least one agitator does not obstruct the opening in the carrier.

13. The drilling unit of claim 9, further comprising a dust chamber within the housing, the at least one agitator projecting into the dust chamber.

14. The drilling unit of claim 9, wherein the at least one agitator comprises an elongated rod.

15. The drilling unit of claim 9, wherein the at least one agitator comprises two agitators.

16. The apparatus of claim 9, further including a pressure source for inducing a flow of air along the flow path.

17. An apparatus for assisting in preventing the accumulation of debris in a flow path during the formation of a borehole in a face of a mine passage, comprising:

a drill bit including a passage forming a flow path for debris from the borehole;

a drill head including a housing and a drive shaft for driving the drill bit to form the borehole; and at least one agitator within the housing and separate from the drill bit for agitating debris in the flow path.

18. The apparatus of claim 17, wherein the drive shaft comprises a rotatable drive shaft including a passage in fluid communication with the passage of the drill bit.

19. The apparatus of claim 18, further including a carrier connected to the drive shaft for carrying the at least one agitator, said carrier including an opening in fluid communication with the passage of the drive shaft.

20. The apparatus of claim 17, wherein the agitator is mounted for movement with the drive shaft.

21. The apparatus of claim 17, wherein the at least one agitator comprises a pair of agitators.

22. The apparatus of claim 17, further including a pressure source for inducing a flow of air along the flow path.

23. A method of manufacturing a drill head for assisting in preventing the accumulation of debris in a flow path during the formation of a borehole in a face of a mine passage using a drill bit actuated by a drive shaft having a passage forming a part of the flow path, comprising:

providing the drill head with at least one agitator for agitating debris in the flow path;

rotating the drive shaft within a housing forming part of the drill head; and using a pressure source to cause flow through the flow path, including the passage of the drive shaft.

24. The method of claim 23, wherein the using step comprises applying a vacuum to the flow path.

* * * * *